United States Patent [19]

Krob et al.

[11] Patent Number: 4,621,829

[45] Date of Patent: Nov. 11, 1986

[54] SAFETY SKI BINDING

[75] Inventors: Erwin Krob; Helmut Bauer, both of Vienna, Austria

[73] Assignee: TMC Corporation, Baar, Switzerland

[21] Appl. No.: 447,864

[22] Filed: Dec. 8, 1982

[30] Foreign Application Priority Data

Nov. 11, 1981 [AT] Austria ..... 5306/81

[51] Int. Cl.[4] ..... A63C 9/085

[52] U.S. Cl. ..... 280/628

[58] Field of Search ..... 280/628, 629, 630, 634

[56] References Cited

U.S. PATENT DOCUMENTS

| | | | |
|---|---|---|---|
| 3,610,650 | 10/1971 | Korger | 280/628 |
| 3,620,545 | 11/1971 | Korger | 280/628 |
| 3,909,029 | 9/1975 | Salomon | 280/628 |
| 4,095,821 | 6/1978 | Salomon | 280/628 |
| 4,243,246 | 1/1981 | Weigl | 280/628 |
| 4,421,341 | 12/1983 | Krob | 280/628 |
| 4,533,155 | 8/1985 | Krob | 280/628 |

FOREIGN PATENT DOCUMENTS

| | | |
|---|---|---|
| 271288 | 5/1969 | Austria . |
| 338151 | 5/1975 | Austria . |
| 2347746 | 5/1974 | Fed. Rep. of Germany . |

*Primary Examiner*—John J. Love
*Assistant Examiner*—Joseph G. McCarthy
*Attorney, Agent, or Firm*—Flynn, Thiel, Boutell & Tanis

[57] ABSTRACT

A safety ski binding part includes a base plate having a cam member supported thereon, a sole holder supported on the base plate for pivotal movement around a vertical axis and a transverse horizontal axis, the sole holder having a shoulder thereon. A lever supported on the base plate for pivotal movement about a transverse axis has a nose engageable with the shoulder. A transversely extending cam surface is provided which is engageable with the cam member. A release spring biases the lever in a direction urging the nose into engagement with the shoulder and a further spring urges the cam member into engagement with the cam surface.

10 Claims, 6 Drawing Figures

SAFETY SKI BINDING

CROSS-REFERENCE TO RELATED APPLICATION

This application is related to application Ser. No. 438,549, filed on Nov. 1, 1982, now U.S. Pat. No. 4,533,155.

FIELD OF THE INVENTION

The invention relates to a safety binding comprising a sole holder which is pivotal about a transverse axis and a vertical axis.

BACKGROUND OF THE INVENTION

A known safety ski binding part includes a sole holder which can be pivoted about a transverse axis and a vertical axis and is held in a position in which it holds a ski shoe by a locking mechanism which yields after predetermined elevational or lateral release forces are exceeded and in which the effective release force is reduced with an increasing change of the direction from the vertical of the forces applied, preferably to a pre-given limit. Two locking parts of the locking mechanism are provided at separated locations on a locking part carrier which is constructed as a swingable lever. One complementary locking part is provided on the rear area of the sole holder and the other complementary locking part is provided on a structural part which is fixed with respect to the ski. The lever is pivotally supported on a holding axis which extends parallel to the transverse axis, which holding axis is in turn arranged in a support member which is pivotal about a pivot pin which forms the vertical axis and is anchored in a base plate, if desired against the force of a return spring, and which lever has on its side which does not face the two locking parts thereon a control surface which is biased by a release spring.

A safety binding of the above-mentioned type is described in Austrian Pat. No. 294 645 (corresponds to U.S. Pat. No. 3,610,650). In this conventional design, which relates both to a front jaw and also to a heel holder, it is disadvantageous that a transverse movement of the binding will not only lead to a release of the transverse locking device, but at the same time permit play in the lift locking device. This is disadvantageous in the case of the use of this conventional ski binding as a heel holder, because a heel holder lift locking is supposed to be somewhat insensitive to purely lateral forces in order to assure a securer ski guiding.

A similar safety ski binding has become known from German OS No. 18 06 780 (corresponds to U.S. Pat. No. 3,620,545). In this binding, the two locking devices for the elevational and lateral release forces are defined by a common locking member and by a locking part carrier which cooperates with this locking member and is effective both for the elevational and also for the lateral release. The carrier has thereby control surfaces which are decisive for the elevational and lateral release. A disadvantage of this conventional design lies in both the locking element and also the carrier being responsible for two release devices. From this it follows that, in particular due to structural conditions, compromises must be accepted. Practical experience has shown that while these compromises were adequate, they were not entirely satisfactory, and for a product which actually was sold on the market, a further cam was created for controlling the lateral release, which cam is provided between the base plate and the housing of the ski binding. This embodiment in turn has the disadvantage that snow, ice or the like can accumulate between the base plate and housing, which can result in the release operation being erratic.

It is also known from FIG. 6 of Austrian Pat. No. 338 151 to arrange a swingably supported lever between the two locking elements, which lever is loaded on its backside by a spring-loaded slide member and holds this slide member in position with its portion which faces the sole down-holding means. The sole holder can be swung up about an axis which extends transversely with respect to the longitudinal direction of the ski, which axis is arranged above the slide member and approximately at the level of the support surface of the sole holder. The vertical axis about which the sole holder is pivotal during lateral loads is formed by two semiaxles or stub shafts which in turn are supported on the lever or the sole holder which is supported on the transverse axis and which can be swung upwardly. This has the result that the transverse axis, upon the occurrence of lateral forces, in the end effect is stressed by thrust forces which must be absorbed by the two bearings of such axis, which can cause the axles to easily be worn out. This circumstance would result in an undesired wobbling of the sole holder.

Austrian Pat. No. 305 843 (corresponds to U.S. Pat. No. 3,876,219) furthermore suggests creating the second locking arrangement between the sole holder and a locking member which is arranged on the ski and is approximately cam-plate-shaped. Even though this design has proven itself in practice, it is somewhat disadvantageous, because stepping into the released binding with difficult ground conditions requires some skill.

It is furthermore known from Austrian Pat. No. 327 759 (corresponds to U.S. Pat. No. 3,954,277) to support the release spring by means of a spring cage in the release lever and to create in this manner a unit which is pivotal about a common swivel axis. This solution permits a swinging up of the heel holder, but does not permit a release of the same in the direction of forces which act diagonally in the space and cause twisting falls.

Further, German OS No. 28 38 904 describes a solution which has been created substantially by combining the features of the two last-mentioned Austrian patents and which also contain their disadvantages. The conventional designs have furthermore the disadvantage that, with an increasing lateral release, the lateral holding mechanism becomes increasingly sensitive to wobbling, which can cause the ski guiding, if a release should not yet take place, to become inexact.

A purpose of the invention is to bring help here and to provide a safety ski binding of the above-mentioned type in which the lever is supported on the complementary locking part which is provided on the ski-fixed structural part.

SUMMARY OF THE INVENTION

This purpose is attained inventively by either the bar member which is provided on the lever being supported resiliently loaded or biased, by at least one resilient element, into engagement with a cam surface on a structural part which is fixed relative to the ski, or the cam surface is supported resiliently relative to a ski-fixed mounting of the structural part.

Through this inventive measure it is assured that the lever in each of its positions is resiliently supported on the structural part which can be fixed on the ski, so that on the one hand, the forces which engage on the lever can be taken over frictionally by the structural part which is fixed relative to the ski and, on the other hand, the release operation can be controlled by selection of the shapes of the corresponding surfaces on the lever and on the structural part which is fixed relative to the ski. Furthermore it is assured in this manner that smaller impacts, which would occur during skiing, do not bring about a release operation, because the mentioned impacts are absorbed by the spring force of the resilient or elastic element, such spring force being substantially weaker compared with the release spring. This means an extension of the elasticity range of the inventive safety ski binding, whereby the other determining characteristics, like dimensions, spring constant etc. can be maintained unchanged. Finally a construction which is substantially protected against environmental influences is created.

An advantageous embodiment of the invention is characterized by a structural part which is fixed relative to the ski being arranged in front of the area of swing of the support member on the base plate of the heel holder, on the area of which heel holder not facing the support member, is provided a cam surface, which is formed by a control surface, a balance bar, roller or sleeve, and by the balance bar, roller or sleeve, with the interpositioning of at least one spring, being supported resiliently on the structural part which is fixed relative to the ski.

A different advantageous embodiment of the invention consists in the structural part which is fixed relative to the ski having a locking bolt secured on at least one abutment, which is formed of an upwardly bent part of the base plate, on bearing points or on a separate binding-fixed abutment or the like, and carries a bar member, i.e. a balance bar, roller or sleeve; and in a cam surface being provided on the lever, which cam surface extends substantially transversely with respect to the longitudinal axis of the ski and has a locking pan for receiving the locking bolt or balance bar, roller or sleeve in the locking pan to block lateral movement as for downhill skiing, and finally is equipped with curved sections smoothly extending laterally from the locking pan in both directions toward the two side edges of the ski for facilitating a controlled twisting fall release. Through this inventive measure, a surface-like support between the cam surface and the bar member is assured particularly favorably and in a simple manner. Furthermore a blocked position of the heel holder against purely lateral outwardly directed forces is achieved and only after the blocked position is overcome is a controlled diagonal release realized.

A further development of this thought of the invention consists in the locking bolt lying in a plane which extends parallel with respect to the upper surface of the ski extending substantially normally with respect to the longitudinal axis of the ski, a balance bar being supported on said locking bolt, the one end region of which balance bar carries the control surface and by the balance bar being supported on the structural part which is secured on the ski loaded or biased by means of a torsion spring. This embodiment facilitates a manufacture in a unit assembly manner for ski bindings, and which have to meet different conditions, for example concerning the age, the weight, the capability of the skier, since only the balance bar and the spring must be designed differently corresponding with the respective requirements.

According to a further characteristic of the invention, the upper side of one of the structural part and the support member is constructed as a stop for the balance bar or has a stop at its upper side, which limits the capability of swing of the balance bar. By determining the inclination of the upper side of the structural part, the limit of the capability of swing of the lever thus can be determined.

A different further development of the aforementioned thought of the invention consists in the locking bolt defining an angle with the upper side of the ski, a bar member which is constructed as a conical (truncated cone-shaped) roller being arranged on the locking bolt, which bar member is loaded or biased by a helical spring which is active in the longitudinal direction of the bolt. Through this the lever continuously is supported always along a surface of the roller, through which favorable friction ratios (surface pressure instead of line pressure) can be achieved.

A further development of said latter thought of the invention consists in the spring being supported with its one end directly on the base of the conical (truncated cone-shaped) roller and with its other end, preferably with the interpositioning of a washer on the abutment. Through this arrangement a particularly compact construction for the structural part which is fixed on the ski can be achieved.

A still further modification of the thought of the invention which has been disclosed above consists in the bolt being arranged on the base plate upright, substantially perpendicularly with respect to said base plate and being secured, for example riveted, to the base plate; in a sleeve which can be reciprocally moved up and down on the bolt being provided as a bar member, which sleeve carries at its free end remote from the base plate a radially outwardly extending flange, whereby the lower partial area of said flange rests on the cam surface on the lever and by the sleeve being loaded or biased by a spring, which is arranged between the upper end of the sleeve and the bottom surface of a head of a bolt. Also in this embodiment, a low friction surface support is assured between the lever and the bar member. The adjustment to different dimensions of the construction can be done through a simple exchange of the sleeve or the suitable selection of the flange on the sleeve.

In a further development of this thought of the invention, it is furthermore provided, that in the upper end of the sleeve there is constructed a recess forming a seat for a spring, whereby the other end of the spring, with the interpositioning of a washer, is supported on the head part of the locking bolt. Through this, on the one hand, a good guiding for the spring is provided, without the requirement for a separate spring cage and, on the other hand, the head of the locking bolt itself can have small dimensions, which circumstance is advantageous for manufacturing reasons because the dimensions of the spring would not have to be considered.

A different characteristic of the invention is seen in the lever consisting of two holding parts which are pivotally supported on the common holding axle, whereby the first holding part carries the nose which cooperates with a counter surface provided on the sole holder and is loaded by the release spring, and the second lever part, referred to the holding axle, is constructed balance-barlike as a two-arm lever; in the cam surface being provided on a structural part fixedly secured to the ski, which balance bar has its one end resting on the cam surface and its other end, with an interpositioning of a spring, supported on the support member. This embodiment is distinguished by the independent development of the lever and the cam surface which associates therewith.

In a further development of said thought of the invention, the first lever part of the lever has a recess therein which extends in longitudinal direction of the ski, whereby the balance-barlike (second) lever part is arranged on the common holding axle and extends through the recess. With this a compact design is achieved, whereby the swivelling of the support member in the horizontal plane brings about an even swivelling and thus a control of the lever.

It is furthermore inventively important in this connection, that the second lever part has at its end adjacent the spring a downwardly directed extension, which serves as a centering device for the spring, and that the forwardly extended region of the support member has a recess which defines a seat for receiving the other end of the spring. Through this even without a lateral guide mechanism a secure holding of the spring is provided.

A still different development of the invention is characterized by the second lever, referred to the holding axle of the lever, about which it is pivotal, being constructed as a two-arm lever with an extension, whereby the free end region of the lever carries the cam surface, which cam surface is engaged by a bar member which is mounted on the structural part which is fixed on the ski, and whereby the extension is constructed as a resilient element (as a resilient support) which rests on the support member, preferably is designed of the material of the second lever part. This embodiment is distinguished due to the one part (one-piece) construction of the balance bar and spring in particular by its simple and expense-saving type of manufacture.

It is furthermore important for the invention, that the resilient element is designed as a bent (curved) member which extends from above downwardly and from the rear forwardly, the cross section of which formation is preferably uniform. With this a type of closed construction of the balance bar and the extension is provided. Furthermore the designer has more freedom with respect to the choice of the dimensions than if the extension which forms the resilient element would be "open" extending rearwardly.

BRIEF DESCRIPTION OF THE DRAWINGS

Further characteristics, advantages and details of the invention will now be described in greater detail with reference to the drawings, which illustrate several exemplary embodiments.

In the drawings:

FIG. 1 is a longitudinal cross-sectional view taken along the line I—I of FIG. 2 and FIG. 2 is a cross-sectional view taken along the line II—II of FIG. 1.

DETAILED DESCRIPTION

Figure 1:
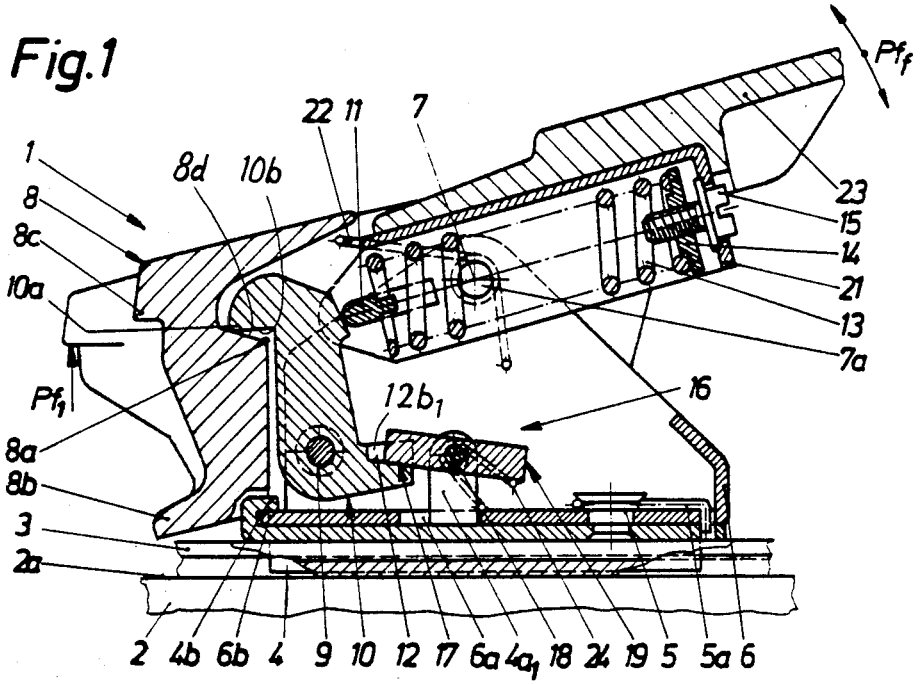
FIGS. 1 and 2 illustrate a first exemplary embodiment of the inventive safety ski binding, whereby

This disclosure is, as stated above, related to our copending application Ser. No. 438549, filed Nov. 1, 1982 and reference thereto is to be incorporated by reference herein.

In the following description, structural parts which have the identical design and function are each identified by the same reference numerals. The structural parts having a different design, but their function however being identical or comparable, are identified by the same reference numerals, however, are differentiated by the suffix addition of one or several primes (', '', ''', $^{IV}$).

Figure 2:
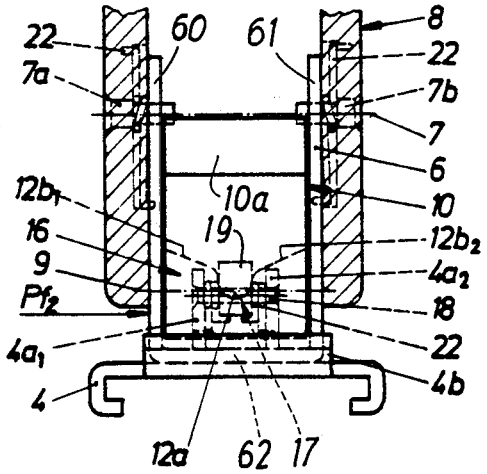

FIGS. 1 and 2 illustrate a safety ski binding which as a whole is shown to be a heel holder 1. The heel holder 1 is supported on the upper surface of the ski 2 in a conventional manner as by means of a base plate 4 movably mounted on a guide rail 3, which in turn is secured on the upper side of a ski 2, for example, by screws (not illustrated). To adjust to different length ski shoes, the heel holder 1 can be moved by means of the base plate 4 relative to the guide rail 3 in the direction of the longitudinal axis of the ski 2 and can be secured (releasably fixed) in a conventional manner in any of several desired positions. The type and manner of the longitudinal adjustment is not part of the subject matter of the present invention.

A U-shaped support member 6 is provided having two parallel upstanding side walls 60 and 61 and an interconnecting bight wall 62. The support member 6 is pivotally secured to the base plate 4 for movement in the horizontal plane about an upright vertical axis, which pivotal securement is constructed as a rivet 5 extending through the base plate 4 and the bight wall 62. The pivotal movement of the support member 6 is preferably against the force of a return spring 5*a*. The use of a torsion return spring 5*a* assures, that the heel holder 1 is returned automatically to its centered position (i.e. in the downhill skiing position) after a swivelling release which occurs at least partially in the horizontal plane.

The support member 6 has adjacent its upper region a pivot axis 7 which extends transversely with respect to the longitudinal axis of the ski and parallel with respect to the upper surface of the ski 2 and which is formed for example by two axle pins 7*a*,7*b* (compare FIG. 2), about which pivot axis 7 a sole holder 8 is upwardly pivotally supported. A holding axle 9 is provided on the support member 6 and extends parallel with respect to the pivot axis 7. The holding axle 9 is centrally arranged between the walls 60 and 61 of the support member 6. A lever 10 is pivotally supported on the holding axle 9. A release lever 23 is also supported on the axle pins 7*a*,7*b* (see only FIG. 1), in which release lever is housed a release spring 13 which loads or biases the lever 10. The arrangement of such a spring in a release lever is known by itself and therefore is not part of the subject matter of the invention. The adjustment of the active force of the release spring 13 occurs in a conventional manner by means of an adjusting screw 15 which is supported on a spring cage 21. The release spring 13 is supported at one of its ends on a movable spring abutment 14 which can be operated or moved by the adjusting screw 15 and at its other end on a slide member 11 which is movably guided in the spring cage 21 on the lever 10.

The lever 10 is a locking member which serves as one of the locking elements which yields to the elevational or vertical release forces, and also as one of the locking elements which is active against the laterally occurring release forces. As a locking member for preventing a swinging up of the heel binding, a nose 10*a* is provided on the lever 10 and engages from the rear a counter or control surface 8*d* on a sole holder 8. The locking system which is active against the swivelling in the horizontal plane is formed by a cam surface 12 on the lever 10. The cam surface 12 will be described in greater detail below. It engages a control surface 17 of a structural part 16 which is fixable on the ski, which control surface 17 will also be described below.

The structural part 16 is, as stated above, fixed on the ski and is formed in the present case by a locking bolt 18 which is supported in an abutment 4*a*, the details of which will be discussed below, and by a balance bar 19 which is pivotally arranged on said locking bolt 18. The locking bolt 18 extends in a plane which lies parallel with respect to the base plate 4 and transversely with respect to the longitudinal axis of the ski, so that the balance bar 19 can be swivelled or pivoted in the plane which lies perpendicular with respect to the upper surface 2*a* of the ski 2. The locking bolt 18 is secured against axial movement in the direction of its longitudinal axis relative to the abutment 4*a*, in a conventional manner, for example by means of two split pins. The control surface 17 is constructed on the (front) end region of the balance bar 19, which end area faces the lever 10. The balance bar 19 is supported on the abutment 4*a* with the interpositioning of a spring 24 which is designed as a torsion spring. The spring 24 urges the bar 19 counterclockwise (FIG. 1) about the bolt 18 and into engagement with the cam surface 12 on the lever 10.

The abutment 4*a* consists of two bearing plates $4a_1$, $4a_2$, which are secured, for example welded, to the upper side of the base plate 4. The abutment 4*a* so formed extends through an opening 6*a* in the support member 6. Since the support member 6 in its mounted position is held at the forward end thereof by a rearwardly bent guide edge 4*b* on the base plate 4, the opening 6*a* in the support member 6 is of a sufficient size or length to enable the support member 6 to be placed over the abutment 4*a* and slid into position beneath the edge 4*b*. In connection with the aforementioned mounting, the opening 6*a* of the support member 6 is therefore first placed over the abutment 4*a*, then the front edge 6*b* of the support member 6 is guided under the guide edge 4*b* of the base plate 4. Thereafter, the support member 6 is pressed forwardly and subsequently the position of the support member 6 on the base plate 4 is fixed by means of the pivot 5.

The cam surface 12 which is provided on the lever 10 has a design which is best shown in FIG. 2. It can thereby be recognized, that in the downhill skiing position of the heel holder 1, the balance bar 19 lies in a locking pan 12*a* of the cam surface 12, which assures a wobble-free mounting in the downhill skiing position of the heel holder 1. Curved sections $12b_1$, $12b_2$ extend smoothly away from both sides of the locking pan, which curved sections extend upwardly inclined in the direction of the two side edges of the ski 2 and according to their design effect the prescribed control during twisting falls. This operation will be discussed in greater detail below.

Through the above-described design of the structural part 16 and of the cam surface 12, it is assured that the lever 10 in each of its positions is supported on the structural part 16, so that during a swivelling or pivoting of the support member 6 and the associated lever 10 in the horizontal plane (due to the occurrence of forces both in the vertical and also in the horizontal plane) the sole holder 8 is also movably guided until its release from the spring loaded lever 10, so that a wobbling of the sole holder 8 or of the heel holder 1 neither in the downhill skiing position nor during a started release operation occurs until the limit of the elasticity is reached.

In order to render the heel holder 1 always ready for a stepping in (i.e. ready for the receipt of a ski shoe therein) after a voluntary or automatic release operation, an opening spring 22 is provided which is constructed for example as a torsion spring which is arranged on the pivot axis 7.

The operation of the heel holder of FIGS. 1 and 2 of the application is as follows. In the position according to FIGS. 1 and 2, a ski shoe which is not illustrated is pressed by the heel holder 1 in a conventional manner against a front jaw, whereby the heel of the ski shoe is held in a conventional manner between the spur 8*b* and the down-holding means 8*c* of the sole holder. If now forces which lie in the vertical plane act onto the ski shoe, then the heel of the shoe presses against the down-holding means 8*c*, as this is indicated by the arrow $Pf_1$, after which the sole holder 8 presses the lever 10 against the force of the release spring 13 about the holding axle 9. At the same time, the surface 10*b* of the lever 10 slides along the control surface 8*d* of the sole holder 8 in the direction toward the rear of the ski 2, namely, until the nose 10*a* of the lever 10 reaches the critical edge 8*a* of the sole holder 8. This position is not illustrated by itself in the drawing; the support of the nose 10*a* of the lever 10 at the critical edge 8*a* of the sole holder 8 should be familiar to the man skilled in the art also without any further explanations. If the force $Pf_1$ which loads the ski shoe ceases to be active while engagement exists between the lever 10 and the sole holder 8 in the aforedescribed manner, the release spring 13 will urge the lever 10 and thus the sole holder 8 against the heel of the shoe in the direction toward the upper surfaces 2*a* of the ski 2 and the skier remains in the binding. If, however, the force $Pf_1$ continues to be active, then the locking between the nose 10*a* of the lever 10 and the critical edge 8*a* of the sole holder 8 is cancelled, thereby permitting the sole holder 8 to then swivel freely in or be additionally resisted by means of the opening spring 22, which causes the ski shoe to be released. If forces are applied to the binding in direction of the arrow $Pf_2$ in the FIG. 2, the heel holder 1 will be blocked against purely lateral forces by the locking pan 12*a* of the cam surface 12 and the receipt therein of the balance bar 19.

If forces which extend in the vertical and in the horizontal plane act simultaneously on the heel holder, then the resulting forces do not only effect a pivoting of the lever 10 about its holding axle 9, as described earlier, the support member 6 is also pivoted about the axis of the pivot 5. As long as the aforementioned engagement between the nose 10*a* of the lever 10 and the critical edge 8*a* of the sole holder 8 exists, there occurs, after the forces $Pf_1$ and $Pf_2$ cease, a swinging back of the support member 6 into the position which corresponds with the downhill skiing position. At the same time, the cam surface 12 of the lever 10 slides on the control surface 17 of the structural part 16 in the direction of one of the sides of the ski 2. When the locking between lever 10 and sole holder 8 is cancelled, then the support member 6, after release of the ski shoe and under the effect of the return spring 5*a*, swings back into its downhill skiing position.

For a voluntary stepping out or opening of the sole holder 8, the release lever 23 is operated. For this the release lever 23 can according to the double arrow $Pf_f$ either be pressed down or pulled up. Such devices, which permit a release in response to an up or down movement of the release lever are known by themselves and are not part of the subject matter of the present invention. It is also known to construct the release lever for receiving the end of a ski pole or a safety strap.

In the now following exemplary embodiments according to FIGS. 3 to 6, those structural parts which are identical with the above described embodiments are identified by the same reference numerals; structural parts, which are identical in the function, however, differ in their construction, have been identified by the same reference numeral and by the addition of one or more primes (', '', ''', etc.). Since the operation of this development is substantially the same as the one already described, only the structural elements which are connected with the lever and its second locking system have been illustrated and described. FIGS. 3 to 6 illustrate this part of the ski binding only in a cross section similar to FIG. 1.

Figure 3:
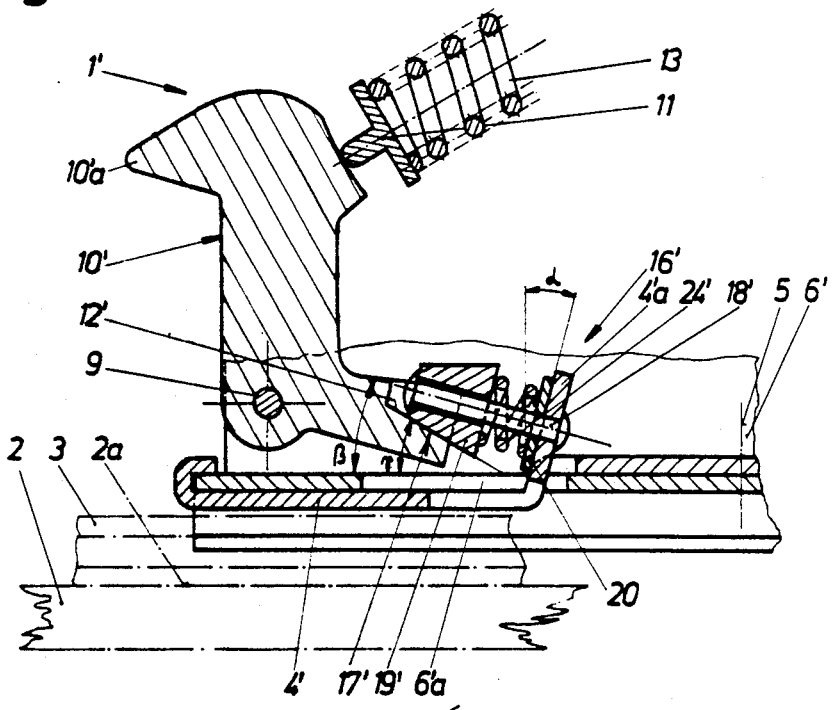
FIGS. 3 to 6 illustrate four further exemplary embodiments, each similar to the illustration of FIG. 1.

In the embodiment according to FIG. 3 the design of the heel holder 1' with respect to the arrangement of its base plate 4' on the guide rail 3 which is secured to the upper surface 2*a* of the ski 2 corresponds with the already described embodiment. Here too the pivot 5 (only schematically illustrated) is provided in the base plate 4', on which pivot only an indicated support member 6' is pivotally supported and is loaded or biased by a return spring which is neither illustrated nor indicated. The lever 10' is pivotal about the holding axle 9; the cam surface 12' on the lever 10' extends in the direction toward the upper surface of the ski at an angle $\gamma$ which will yet be described. The structural part 16' which is fixed relative to the ski is in the present case secured on an abutment 4'*a*, which extends in an upwardly inclined manner through the opening 6*a* in the support member 6'. The end of the abutment 4'*a*, which carries the structural part 16' differs therefore at an angle $\alpha$ from the plane which extends normally with respect to the base plate 4' and with respect to the longitudinal axis of the ski 2. Thus, the longitudinal axis of the locking bolt 8 in this embodiment defines an angle $\beta$ with the upper side of the base plate 4' and the upper surface 2*a* of the ski. Due to the geometric design, theoretically the angle $\alpha$ equals the angle $\beta$; however in practice deviations are generally created. The roller 19' is here designed conically (truncated cone-shaped), whereby its control surface 17', which viewed in cross section is illustrated by the lower boundary line, defines the angle $\gamma$ with the upper side of the base plate 4'. Due to this design the base plane of the cam surface 12' of the lever 10' extends also inclined at the angle $\gamma$ with respect to the upper side of the base plate 4'.

It must be assured that in the different positions of the lever 10' various regions of the cam surface 12' rest on the control surface 17' of the roller 19'. The conical (truncated cone-shaped) roller 19' is for this purpose loaded or biased by a compression spring 24' in the direction toward the lever 10'. This design of the structural part 16' assures a support of the lever 10' on the roller 19' in each position of the lever 10' along a surface on the not illustrated sole holder, whereby the cam surface 12' on the lever 10 is manufactured so that it extends parallel with respect to the control surface 17' of the roller 19'. With this a particularly simple manufacture of the cam surface is possible. Further, and through this design of the second locking system of the lever 10', it is further assured that in each position of the lever 10' and between the cam surface 12' and the control surface 17' on the structural part 16' there is assured a support which occurs along a surface section or interface. This is advantageous in order to avoid—in relation to the surface interface—high, undesired pressures, as would occur for example in instances of engagement along a line. The slightly more complicated design of this type of locking and the therewith associated higher manufacturing expenses are offset by the better friction ratios.

The compression spring 24' is supported in the present exemplary embodiment at one end on an interpositioned washer 20 on the abutment 4'*a* of the base plate 4'. This measure is advantageous because the support surface and thus the dimensioning of the spring 24' does not depend on the design and on the dimensioning of the abutment 4'*a*. Such a washer or a similar washer could also be provided on the side of the abutment 4'*a* remote from the adjacent end of the spring 24', namely between the abutment 4'*a* and the riveted head of the locking bolt 18'. Through this construction a rivet head having relatively small dimensions can assure a secure fastening.

The locking bolt 18' itself is held in every case on the abutment 4'*a*. This can be done for example through the use of a threaded bolt as a locking bolt, which is received in an internally threaded opening in the abutment 4'*a*, or the locking bolt 18' is secured in the abutment 4'*a* with press or forced fit.

The operation of this heel holder 1' should be familiar to the man skilled in the art without any further explanations in connection with the first exemplary embodiment. For this reason an illustration for a combined release operation is also not shown in this case. Should such an illustration for whatever reason become necessary, reference is right from the start made to the sufficient original disclosure according to FIGS. 1 and 2 and the associated description.

Figure 4:
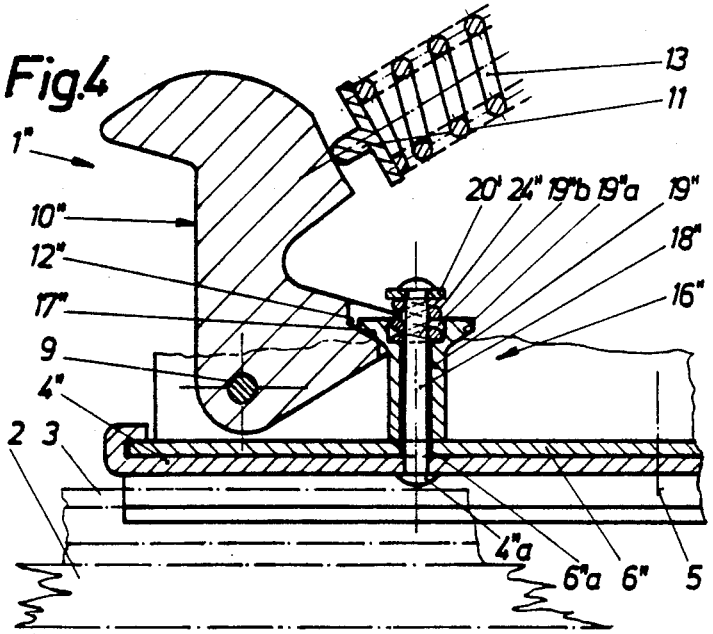

In the embodiment according to FIG. 4, the locking bolt 18'' is arranged upright perpendicularly with respect to the base plate 4'' and is held on said base plate 4'' for example by means of a rivet head 4''*a*. The design of the support member 6'' corresponds substantially with the already described embodiment with the difference, that an arc-shaped slot 6''*a* is provided in the region of the locking bolt 18'', which slot 6''*a* assures the pivoting of the support member 6'' about the axis of the pivot 5.

A reciprocally up and down movable sleeve 19'' is arranged on the locking bolt 18''. The sleeve 19'' has an enlarged radially outwardly extending flange 19''*a* at its free upper end region. A control surface 17'' is provided at its lower region. The underside of the flange 19''*a* rests on or engages the cam surface 12'' of the lever 10''. A spring 24'' is further provided concentrically with respect to the locking bolt 18'' and loads or biases the sleeve 19'' in a direction toward the upper surface of the ski and one end thereof is received in a recess 19''*b* in the upper end of the sleeve 19''. The other end of the spring 24'' is supported on a washer 20' which serves as a spring abutment and which in turn is supported on the head of the locking bolt 18''. Locking bolt 18'' and sleeve 19'' from here the structural part 16'' which is fixed on the ski.

The operation and all further references, which have been made in connection with the embodiment according to FIG. 3, are also true for the heel holder 1″ according to this exemplary embodiment. In addition, it is to be particularly emphasized that through the arced design of the control surface 17″ of the sleeve 19″ difficult requirements for the control can be accomplished.

Figure 5:
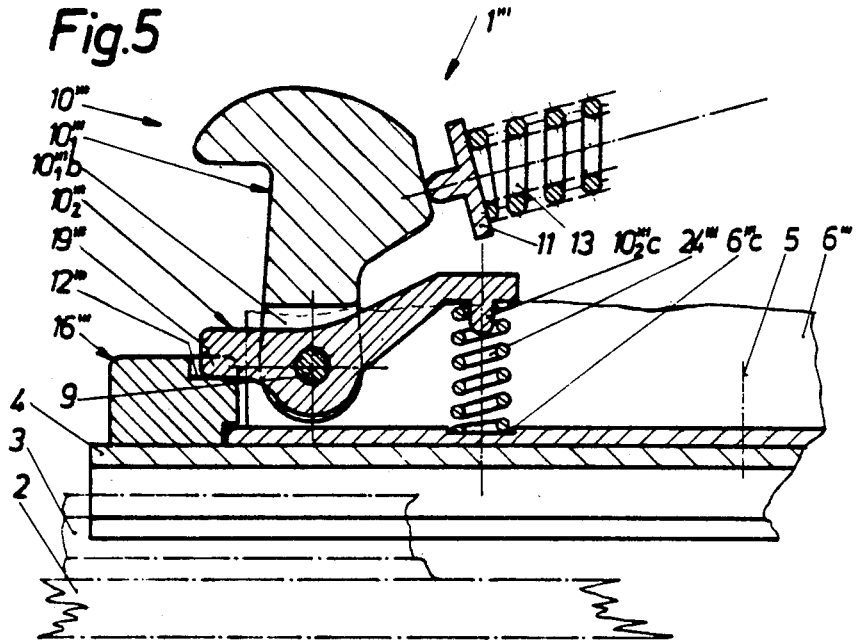

In the embodiment according to FIG. 5, cam surface 12‴ is provided on a forwardly located structural part 16‴ fixedly secured to the base plate 4 and the end area of a balance-barlike designed lever part $10'''_2$ of the here two-part lever 10‴ is adapted to engage the cam surface 12‴. In the present exemplary embodiment, the second lever part $10'''_2$ is resiliently urged against the cam surface 12‴ to function as a cam member 19‴. With this structure it will be noted that between the lever 10‴ and the structural part 16‴ the same relative movement will take place as in the previously discussed embodiments, wherein the cam surface 12,12′,12″ is provided on the lever 10,10′,10″, respectively, and the balance bar 19 acts as a cam member (FIGS. 1 and 2), a roller 19′ (FIG. 3) or a sleeve 19″ (FIG. 4) on the structural part 16,16′,16″ which is fixed relative to the ski.

The first lever part $10'''_1$ has a recess $10'''_1b$ therein, which recess receives the second lever part $10'''_2$ therein. The first and second lever parts $10'''_1$, $10'''_2$ are supported on a common holding axle 9. The end region of the second lever part $10'''_2$ remote from the cam surface 12‴ is supported on a support member 6‴ through means of a compression spring 24‴. In this manner the entire lever 10‴ is resiliently supported with respect to the structural part 16‴ fixed relative to the ski, through which a similar effect, as was described above in connection with the preceding exemplary embodiments, is achieved.

To determine the position of the spring 24‴, same is supported at one end in a recess on the support member 6‴, which recess serves as seat 6‴c and at the other end is guided in a centered manner onto an extension $10'''_2c$ on the second lever part $10'''_2$ and simultaneously is supported thereon.

The further design of FIG. 5 and the operation of said heel holder 1‴ corresponds otherwise with the already described embodiments. This design is distinguished by a certain independency of the balance bar $10'''_2$ and the cam surface 12‴ from the lever, whereby the lever itself experiences the control functions just like in the preceding exemplary embodiments.

Figure 6:
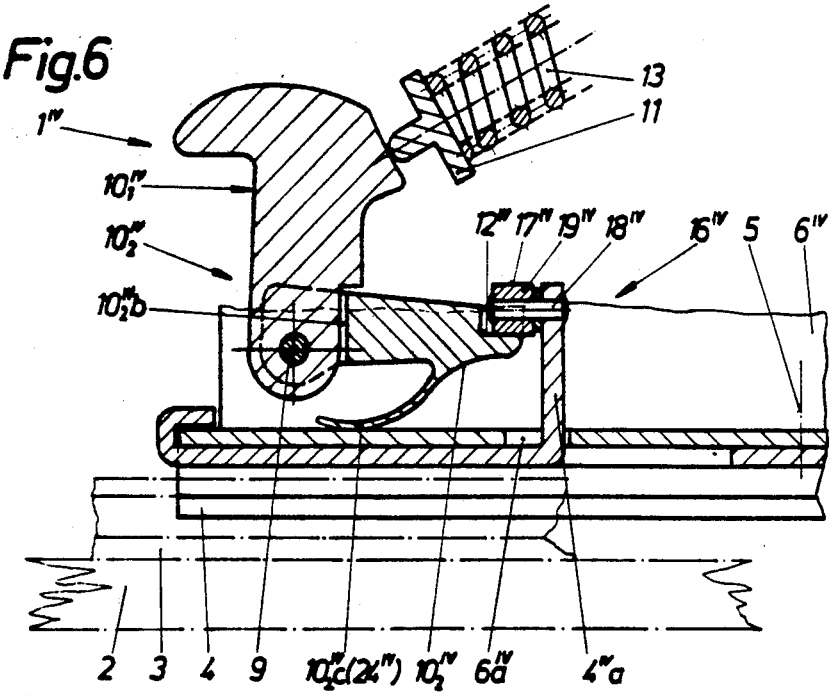

In the exemplary embodiment according to FIG. 6 the lever $10^{IV}$, similar to the preceding exemplary embodiment of FIG. 5, is constructed in two parts, whereby the first and the second lever part $10^{IV}_1$ or $10^{IV}_2$ are arranged pivotally here too on the common holding axle 9. The second lever part $10^{IV}_2$ carries in this case on its one end region the cam surface $12^{IV}$ and cooperates with a roller $19^{IV}$ provided on the structural part $16^{IV}$ which is fixed relative to the ski and is, referred to the holding axle 9, constructed as a one-arm lever. The so-designed second lever part $10^{IV}_2$ grips with its bifurcated other end remote from the cam surface $12^{IV}$ defining a frontwardly opening recess $10^{IV}_2b$ around the first lever part $10^{IV}_1$, so that also in this case a balance-barlike structure is created. The second lever part $10^{IV}_2$ which is designed as a one-arm lever has an arcuate extension $10^{IV}_2c$, which is resilient and functions as a resilient support $24^{IV}$, and extends approximately from the central, lower region of the second lever part $10^{IV}_2$ in a direction toward the holding axle 9 and rests on the forward region of the support member $6^{IV}$.

The structural part $16^{IV}$ which is fixed relative to the ski is—similar to the first exemplary embodiment according to FIGS. 1 and 2—constructed of the material of the base plate $4^{IV}$ and extends through an opening $6^{IV}a$ of the support member $6^{IV}$. The balance bar is constructed in the present exemplary embodiment as a roller $19^{IV}$, which roller is supported on a locking bolt $18^{IV}$ held in the structural part $16^{IV}$ which is fixed relative to the ski. The outer surface of the roller $19^{IV}$ thereby functions as a control surface $17^{IV}$.

The operation and all further references, which have been made in connection with the preceding embodiments in general, also are valid for the heel holder $1^{IV}$ according to the embodiment of FIG. 6.

The invention is not limited to the illustrated exemplary embodiments. Further modifications exist without departing from the scope of protection. In particular, described details of one or the other embodiment can be used with suitable adjustment in a different embodiment. For example, the roller which is active as a balance bar according to FIG. 6 can also be used on the lever arm according to FIG. 5 or one can provide the structural part which is fixed relative to the ski according to FIG. 6 with a cam surface, similar to the embodiment according to FIG. 5. It is also possible to exchange the cam surface and the cam member locally if the cam surface is provided on the lever and the cam member—with or without roller—on the structural part which is be fixed relative to the ski. Also the design of the individual spring types is not to be limited to one exemplary embodiment; it is possible furthermore to replace compression springs or the resilient support with a different type of spring, for example with cup springs.

The structural part which is fixed relative to the ski can be designed not only, as has been described, of the material of the base plate; it is also possible to use separate bearing blocks, for example as has been illustrated in FIG. 5 and has been described in connection with this figure. Such a structural element is then secured to the base plate of the heel holder for example by means of rivets. Such a measure requires more work than a punching operation which is described in connection with FIG. 1, however, can possibly, if for example the base plate is not weakened, be advantageous. The type of the fastening of such a structural element should be familiar to the man skilled in the art without any further discussions.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a safety ski binding which is adapted to be secured to a ski and includes a sole holder which is pivotal about a transverse axis and a vertical axis and is releasably held in a position in which it holds a ski shoe by a locking mechanism which yields only after predetermined release forces are exceeded, the effective release force being reduced with an increasing change from the vertical in the direction of application thereof, wherein first and second locking parts of said locking mechanism are provided at spaced locations on a swingable lever, and a first complementary locking part which is engageable with said first locking part is provided on a rear region of said sole holder and a second complementary locking part which is engageable with said second locking part is provided on a structural part which is fixable with respect to the ski, and wherein said lever is supported for pivotal movement about a holding axle which extends parallel to said transverse axis and which is in turn supported on a support member which is pivotal about a pivot pin which defines said vertical axis and is anchored in a base plate adapted to be secured to the ski, said lever having on a side thereof remote from said locking parts a control surface which is biased by a release spring, the improvement comprising wherein said second complementary locking part is formed by a further control surface provided on a balance bar which is movably supported on said structural part, and wherein said balance bar is resiliently biased with respect to a ski-fixed mounting of said structural part by at least one biasing spring which is interpositioned between said balance bar and said mounting and which urges said second complementary locking part in a direction toward said second locking part.

2. The binding according to claim 1, wherein said structural part is arranged on said base plate of said heel holder in front of said pivot pin for said support member, and wherein said second complementary locking part is a further control surface provided on a portion of said balance bar nearest said sole holder.

3. The binding according to claim 1, wherein said structural part includes a locking bolt supported on at least one abutment formed by one of an upwardly bent part of said base plate and a bearing plate secured on said base plate, wherein said locking bolt lies in a plane which extends parallel with respect to the upper side of the ski, wherein said locking bolt extends substantially normal to the longitudinal axis of the ski, and wherein said balance bar is pivotally supported on said locking bolt and is pivotally biased by said biasing spring, said biasing spring being a torsion spring.

4. The binding according to claim 1, wherein said second locking part is a cam surface which is provided on said lever, said cam surface extending substantially transversely with respect to the longitudinal axis of the ski and having a centrally located locking pan for receiving therein a portion of said balance bar having a control surface thereon to block a pure lateral release of said ski binding, said cam surface having curve sections adjacent said locking pan which extend in both directions toward the two side edges of the ski for facilitating a controlled release during a twisting fall.

5. A safety ski binding which is adapted to be secured on a ski, comprising a sole holder which is pivotal about a transverse axis and a vertical axis and can be releasably held in a downhill skiing position in which it holds a ski shoe by a locking mechanism which yields only after predetermined release forces are exceeded, the effective release force being reduced with an increasing change from the vertical in the direction of application thereof, wherein first and second locking parts of said locking mechanism are provided at spaced locations on a swingable lever, and a first complementary locking part which is engageable with said first locking part is provided on a rear region of said sole holder and a second complementary locking part which is engageable with said second locking part is movably supported on a structural part which is fixedly secured on a base plate adapted to be secured to the ski, and wherein said lever is supported for pivotal movement about a holding axle which extends parallel to said transverse axis and which is in turn supported on a support member which is pivotal about a pivot pin which defines said vertical axis and is anchored in said base plate, said lever having on a side thereof remote from said locking parts a control surface which is biased by a release spring, and including resilient means separate from said release spring for yieldably urging movement of said second complementary locking part relative to said structural part and into engagement with said second locking part, and wherein said second complementary locking part is one of an elongate balance bar having an end engageable with said second locking part and being pivotally supported at a location between its ends on said structural part, and a sleeve supported on said structural part for vertical movement and for rotation about a vertical axis and having adjacent an upper end thereof a radially outwardly extending flange engageable with said second locking part.

6. The binding according to claim 5, wherein said structural part is arranged in front of said pivot pin and includes a mounting fixedly supported on said base plate, and wherein said resilient means includes a spring which engages said second complementary locking part and said mounting and yieldably urges movement of said second complementary locking part relative to said mounting in a direction toward said second locking part.

7. The binding according to claim 5, wherein said structural part includes a locking bolt supported on an abutment formed by one of a bent up part of said base plate and bearing points secured on said base plate, wherein said locking bolt movably supports said second complementary locking part which is said balance bar, wherein said second locking part is a cam surface which is provided on said lever, extends substantially transversely with respect to the longitudinal axis of the ski, and has a locking pan for receiving the end of said balance bar in a downhill skiing position, said cam surface also having curved sections smoothly extending away from the lateral edges of said locking pan in both directions toward the two side edges of the ski for facilitating a controlled release during a twisting fall.

8. A safety ski binding which is adapted to be secured on a ski, comprising a sole holder which is pivotal about a transverse axis and a vertical axis and can be releasably held in a downhill skiing position in which it holds a ski shoe by a locking mechanism which yields only after predetermined release forces are exceeded, the effective release force being reduced with an increasing change from the vertical in the direction of application thereof, wherein first and second locking parts of said locking mechanism are provided at spaced locations on a swingable lever, and a first complementary locking part which is engageable with said first locking part is provided on a rear region of said sole holder and a second complementary locking part which is engageable with said second locking part is provided on a structural part which is fixable with respect to the ski, and wherein said lever is supported for pivotal movement about a holding axle which extends parallel to said transverse axis and which is in turn supported on a support member which is pivotal about a pivot pin which defines said vertical axis and is anchored in a base plate adapted to be secured to the ski, said lever having on a side thereof remote from said locking parts a control surface which is biased by a release spring, and including resilient means separate from said release spring for yieldably urging relative movement of said second locking part and said second complementary locking part into a position of engagement with each other, wherein said structural part includes a locking bolt supported on at least one abutment formed by one of a bent up part of said base plate and bearing points secured on said base plate, wherein said locking bolt movably supports said second complementary locking part which is one of a balance bar, a roller and a sleeve, wherein said second locking part is a cam surface which is provided on said lever, extends substantially transversely with respect to the longitudinal axis of the ski, and has a locking pan for receiving said second complementary locking part in a downhill skiing position, said cam surface also having curved sections smoothly extending away from the lateral edges of said locking pan in both directions toward the two side edges of the ski for facilitating a controlled release during a twisting fall, wherein said locking bolt lies in a plane which extends parallel with respect to the upper side of the ski, wherein said locking bolt extends substantially normal to the longitudinal axis of the ski, wherein said second complementary locking part is said balance bar and is supported on said locking bolt, one end of said balance bar having a control surface thereon which is engageable with said cam surface, and wherein said resilient means includes a torsion spring which cooperates with said balance bar and said abutment and urges movement of said balance bar relative to said abutment in a direction corresponding to movement of said control surface into engagement with said cam surface.

9. The binding according to claim 5, wherein said structural part includes a bolt which is arranged upright on said base plate substantially perpendicular thereto and is fixedly secured thereon, wherein said second complementary locking part is said sleeve, said sleeve being rotatably and axially movably supported on said bolt, and wherein said resilient means includes a biasing spring arranged between an upper side of said sleeve and an underside of a head provided at the upper end of said bolt, said biasing spring urging said sleeve downwardly.

10. The binding according to claim 9, wherein said upper side of said sleeve has a recess therein which receives one end of said biasing spring, and wherein the other end of said biasing spring engages a washer which is supported on said head of said bolt.

* * * * *